US009209517B2

(12) United States Patent
Choi et al.

(10) Patent No.: US 9,209,517 B2
(45) Date of Patent: Dec. 8, 2015

(54) MIMO/DIVERSITY ANTENNA FOR IMPROVING THE ISOLATION OF A SPECIFIC FREQUENCY BAND

(75) Inventors: Sang-Hoon Choi, Anyang-shi (KR); Young-Sang Kim, Seoul (KR); Bu-Seok Shim, Seoul (KR)

(73) Assignee: MOBITECH CORP., Seoul (KR)

( * ) Notice: Subject to any disclaimer, the term of this patent is extended or adjusted under 35 U.S.C. 154(b) by 196 days.

(21) Appl. No.: 13/983,568

(22) PCT Filed: Feb. 8, 2012

(86) PCT No.: PCT/KR2012/000912

§ 371 (c)(1),
(2), (4) Date: Aug. 4, 2013

(87) PCT Pub. No.: WO2012/108682

PCT Pub. Date: Aug. 16, 2012

(65) Prior Publication Data

US 2013/0307744 A1 Nov. 21, 2013

(30) Foreign Application Priority Data

Feb. 9, 2011 (KR) ..... 10-2011-0011420

(51) Int. Cl.
*H01Q 1/24* (2006.01)
*H01Q 1/52* (2006.01)
(Continued)

(52) U.S. Cl.
CPC ..... *H01Q 1/523* (2013.01); *H01Q 1/241* (2013.01); *H01Q 1/521* (2013.01); *H01Q 9/0421* (2013.01); *H01Q 21/28* (2013.01)

(58) Field of Classification Search
CPC ..... H01Q 1/521; H01Q 1/241; H01Q 1/523; H01Q 21/28; H01Q 9/0421
USPC ..... 343/700 MS, 846
See application file for complete search history.

(56) References Cited

U.S. PATENT DOCUMENTS 6,252,552 B1 * 6/2001 Tarvas ..... H01Q 9/0421 343/700 MS
6,417,817 B1 * 7/2002 Pirila ..... H01Q 1/243 343/700 MS (Continued)

FOREIGN PATENT DOCUMENTS

KR 10-2010-0064008 A 6/2010
KR 10-2010-0083074 A 7/2010

(Continued)

OTHER PUBLICATIONS

International Search Report for International Application No. PCT/KR2012/000912.

*Primary Examiner* — Tho G Phan
(74) *Attorney, Agent, or Firm* — LRK Patent Law Firm

(57) ABSTRACT

A MIMO/diversity antenna for improving isolation of a frequency band includes: a ground surface formed on a printed circuit board; planar inverted F antennas having the ground surface therebetween and disposed on the printed circuit board having no ground surface formed, each F antenna having an antenna pattern that includes a radiation unit, a power supply unit, and a ground unit; power supply pads and ground pads formed on the printed circuit board having no ground surface formed corresponding to the power supply unit and the ground unit of the antenna pattern in the planar inverted F antennas; and connection patterns connecting the ground surface with each ground pad to electrically connect the ground surface to each ground unit of the antenna pattern in the planar inverted F antennas. At least one of the connection patterns is formed with a strip line of a meandering shape.

5 Claims, 5 Drawing Sheets

(51) Int. Cl.
*H01Q 9/04* (2006.01)
*H01Q 21/28* (2006.01)

(56) References Cited

U.S. PATENT DOCUMENTS 6,693,594 B2 * 2/2004 Pankinaho ..... H01Q 1/243 343/700 MS
6,738,023 B2 * 5/2004 Scott ..... H01Q 1/243 343/700 MS
7,504,998 B2 * 3/2009 Choi ..... H01Q 1/22 343/700 MS
8,111,199 B2 * 2/2012 Baliarda ..... H01Q 9/0421 343/700 MS
8,164,524 B2 * 4/2012 Tang ..... H01Q 5/364 343/700 MS

FOREIGN PATENT DOCUMENTS

KR 10-2010-0108062 A 10/2010
KR 10-0986702 B1 10/2010

* cited by examiner

MIMO/DIVERSITY ANTENNA FOR IMPROVING THE ISOLATION OF A SPECIFIC FREQUENCY BAND

TECHNICAL FIELD

The present invention relates to a MIMO/diversity antenna for providing the isolation of a specific frequency band and, more particularly, to a MIMO/diversity antenna for providing the isolation of a specific frequency band, in which at least one connection pattern of a plurality of connection patterns that are formed between a ground surface and ground portions provided in a plurality of planar inverted-F antennas is formed of a meander line-shaped stripline, thereby minimizing the distribution of current components shared on the ground surface by the plurality of planar inverted-F antennas and also preventing electromagnetic interference attributable to electromagnetic waves radiated from the plurality of planar inverted-F antennas, resulting in an improvement in isolation and antenna characteristics.

BACKGROUND ART

Internal antennas are preferred to external antennas for mobile communication terminals because of the preference for the aesthetic aspect of terminals. In order to provide various mobile communication services, such as Bluetooth, WiBro, digital broadcasting, and global roaming services, the demand for internal antennas that operate in multiple bands is increasing.

Representative external antennas are implemented using helical antenna technology, whereas representative internal antennas that operate in multiple bands are implemented using planar inverted-F antenna (PIFA) technology including antenna patterns each including a radiation portion, a ground portion, and a feeding portion formed at a location adjacent to the ground portion and configured such that feeding signals are input thereto.

Meanwhile, because of the demand for high-speed multimedia services using wireless mobile communication technology, interest in antenna technology that is capable of increasing communication capacity in mobile communication systems is increasing.

Technologies that have been proposed to meet the demand include a Multi-Input Multi-Output (MIMO) antenna technology that employs two or more antennas for each of a base station and a mobile communication terminal, transmits data via various paths, and detects signals received via the paths at a receiving end, and a diversity antenna technology that receives signals using two or more antennas and detects received signals by combining output. MIMO/diversity antennas have the advantages of increasing the reliability of transmitted data and overcoming limitations regarding the amount of transmission of mobile communication.

However, such MIMO/diversity antennas are problematic in that an interference phenomenon attributable to electromagnetic wave signals occurs between a plurality of antennas because the plurality of antennas operate in the same frequency band. In particular, when MIMO/diversity antennas operate in a frequency band lower than 1 GHz, the guarantee of isolation between a plurality of antennas becomes the most important issue because of the limited length of a ground surface.

FIG. 1 is a diagram schematically illustrating current components shared on a ground surface by a plurality of planar inverted-F antennas that constitute a conventional MIMO/diversity antenna, and FIG. 2 is a diagram illustrating the isolation of the conventional MIMO/diversity antenna.

As illustrated in FIG. 1, in conventional MIMO/diversity antennas, ground pads 30 corresponding to respective ground portions that constitute a plurality of planar inverted-F antennas 10 and 20 are located in a diagonal direction in order to maximize the physical length of a ground, surface 1 in a limited ground surface structure.

In this case, when the operating frequency of a MIMO/diversity antenna is, for example, about 900 MHz and the MIMO/diversity antenna operates in its adjacent frequency band, the length of a common ground surface 1 is 80 mm, which is $\lambda/4$ of the operating frequency.

However, the conventional MIMO/diversity antenna is problematic in that sufficient isolation cannot be ensured in a frequency band lower than 1 GHz, as illustrated in FIG. 2, because an interference phenomenon attributable to electromagnetic waves occurs between the plurality of planar inverted-F antennas because of current components shared on the ground surface between the plurality of planar inverted-F antennas 10 and 20.

Accordingly, there is an urgent need for a practical and useful technology that is capable of providing a MIMO/diversity antenna for minimizing current components shared on a ground surface on a printed circuit board and also preventing electromagnetic interference attributable to electromagnetic waves radiated from a plurality of planar inverted-F antennas, thereby improving isolation.

DISCLOSURE

Technical Problem

Accordingly, the present invention has been made keeping in mind the above problems occurring in the prior art, and an object of the present invention is to provide a MIMO/diversity antenna for providing the isolation of a specific frequency band, in which, in order to electrically connect a ground surface formed on a PCB with ground portions provided in the antenna patterns of a plurality of planar inverted-F antennas, at least one connection pattern of a plurality of connection patterns that connect the ground surface with ground pads is forced of a meander line-shaped stripline, thereby minimizing the distribution of current components shared on the ground surface by the plurality of planar inverted-F antennas and also preventing electromagnetic interference attributable to electromagnetic waves radiated from the plurality of planar inverted-F antennas, resulting in an improvement in isolation and antenna characteristics.

Technical Solution

In order to accomplish the above object, the present invention provides a MIMO/diversity antenna for improving the isolation of a specific frequency band, including a ground surface formed on a printed circuit board (PCB); a plurality of planar inverted-F antennas disposed on portions of the PCB where the ground surface is not formed, with the ground surface being interposed therebetween, and configured to have antenna patterns each including a radiation portion, a feeding portion, and a ground portion; a plurality of feeding pads and ground pads formed on portions of the PCB where the ground surface is not formed, so as to correspond to the feeding and ground portions of the antenna patterns provided in the plurality of planar inverted-F antennas; and a plurality of connection patterns configured to connect the ground surface with the ground pads in order to electrically connect the ground surface to the ground portions provided in the antenna patterns of the plurality of planar inverted-F antennas; wherein at least one connection pattern of the plurality of connection patterns is formed of a meander line-shaped stripline, thereby minimizing distribution of current components shared on the ground surface by the plurality of planar inverted-F antennas, and also preventing electromagnetic interference attributable to electromagnetic waves radiated irons the plurality of planar inverted-F antennas.

In order to accomplish the above object, the present invention provides a MIMO/diversity antenna for improving the isolation of a specific frequency band, including a ground surface formed on a PCB; a plurality of planar inverted-F antennas disposed on portions of the PCB where the ground surface is not formed, with the ground surface being interposed therebetween, and configured to have respective antenna patterns each including a radiation portion, a feeding portion, and a ground portion and operating in multiple frequency bands; a plurality of feeding pads and ground pads formed on portions of the PCB where the ground surface is not formed, so as to correspond to the feeding and ground portions of the antenna patterns provided in the plurality of planar inverted-F antennas; and a plurality of connection patterns configured to connect the ground surface with the ground pads in order to electrically connect the ground surface to the ground portions provided in the antenna patterns of the plurality of planar inverted-F antennas; wherein at least one connection pattern of the plurality of connection patterns is formed of a meander line-shaped stripline, thereby minimizing distribution of current components shared on the ground surface by the plurality of planar inverted-F antennas, and also preventing electromagnetic interference attributable to electromagnetic waves radiated from the plurality of planar inverted-F antennas.

Advantageous Effects

As described above, the present invention has the advantage of providing a MIMO/diversity antenna in which, in order to electrically connect the ground surface formed on the PCB with the ground portions provided in the antenna patterns of the plurality of planar inverted-F antennas, at least one connection pattern of a plurality of connection patterns that connect the ground surface with the ground pads is formed of a meander line-shaped stripline, thereby minimizing the distribution of current components shared on the ground surface by the plurality of planar inverted-F antennas and also preventing electromagnetic interference attributable to electromagnetic waves radiated from the plurality of planar inverted-F antennas, resulting in an improvement in isolation and antenna characteristics.

MODE FOR INVENTION

A MIMO/diversity antenna for improving the isolation of a specific frequency band according to the present invention includes a ground surface formed on a printed circuit board (PCB); a plurality of planar inverted-F antennas disposed on portions of the PCB where the ground surface is not formed, with the ground surface being interposed therebetween, and configured to have antenna patterns each including a radiation portion, a feeding portion, and a ground portion; a plurality of feeding pads and ground pads formed on portions of the PCB where the ground surface is not formed, so as to correspond to the feeding and ground portions of the antenna patterns provided in the plurality of planar inverted-F antennas; and a plurality of connection patterns configured to connect the ground surface with the ground pads in order to electrically connect the ground surface to the ground portions provided in the antenna patterns of the plurality of planar inverted-F antennas; wherein at least one connection pattern of the plurality of connection patterns is formed of a meander line-shaped stripline, thereby minimizing distribution of current components shared on the ground surface by the plurality of planar inverted-F antennas, and also preventing electromagnetic interference attributable to electromagnetic waves radiated from the plurality of planar inverted-F antennas.

Furthermore, in the MIMO/diversity antenna for improving the isolation of a specific frequency band according to the present invention, it is preferred that the antenna patterns provided in the plurality of planar inverted-F antennas operate in a specific frequency band lower than 1 GHz, and a total length obtained by summing the length of the plurality of connection patterns and the length of the ground surface formed between the plurality of planar inverted-F antennas be equal to or greater than $3\lambda/8$ of the specific frequency band in which the frequency pattern operates.

Preferred embodiments according to the present invention will be described in detail with reference to the accompanying drawings.

Figure 3:
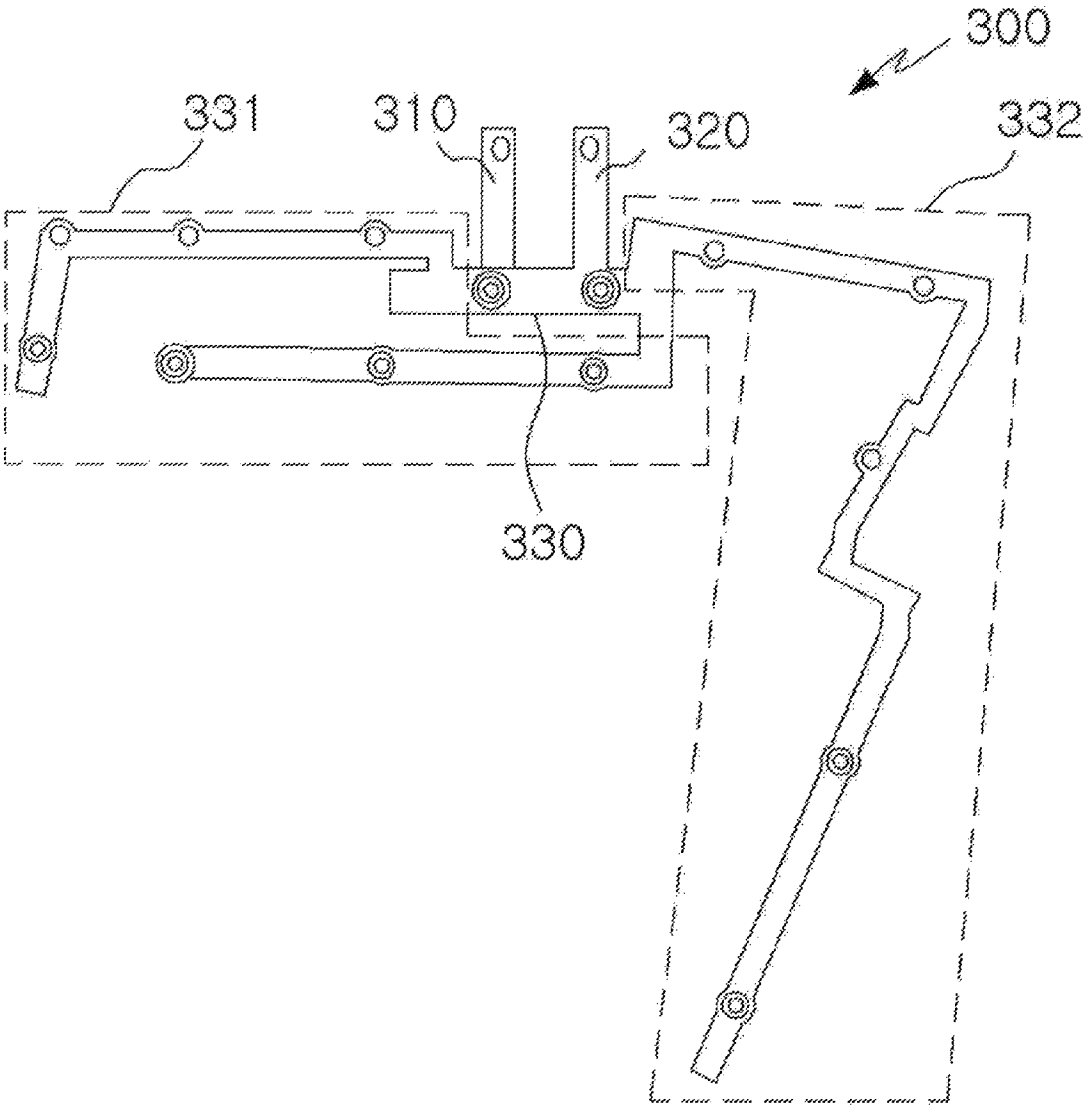
FIG. 3 is a schematic configuration diagram illustrating an antenna pattern included in a plurality of planar inverted-F antennas that constitute a MIMO/diversity antenna according to an embodiment of the present invention.

FIG. 3 is a schematic configuration diagram illustrating an antenna pattern included in a plurality of planar inverted-F antennas that constitute a MIMO/diversity antenna according to an embodiment of the present invention.

As illustrated in this drawing, an antenna pattern 300 included in each of a plurality of planar inverted-F antennas 100 and 200 that constitute a MIMO/diversity antenna according to this embodiment of the present invention includes a feeding portion 310 configured to receive a feeding signal and to correspond to a feeding pad 410 formed on a printed circuit board, a ground portion 320 configured to correspond to a ground pad 420 formed on the printed circuit board to electrically connect to a ground surface 1, and a radiation portion 330 configured to include a high frequency pattern 331 and a low frequency pattern 332 and to operate in multiple frequency bands.

Furthermore, the feeding portion 310 of the antenna pattern 300 included in each of the plurality of planar inverted-F antennas 100 and 200 and configured to operate in multiple frequency bands is configured to be disposed on a high frequency pattern 331 side configured to operate in a relatively high frequency band, and the ground portion 320 of the antenna pattern 300 is configured to be disposed on a low frequency pattern 332 side configured to operate in a relatively low frequency band.

In this case, in the embodiment of the present invention, the high frequency pattern 331 is configured to operate in a frequency band equal to or higher than 1 GHz, that is, a relatively high frequency band, for example, at about 1.6 GHz and about 1.9 GHz, and the low frequency pattern 332 is configured to operate in a frequency band lower than 870 MHz, that is, a relatively low frequency band, for example, at a frequency of about 870 MHz.

Figure 4:
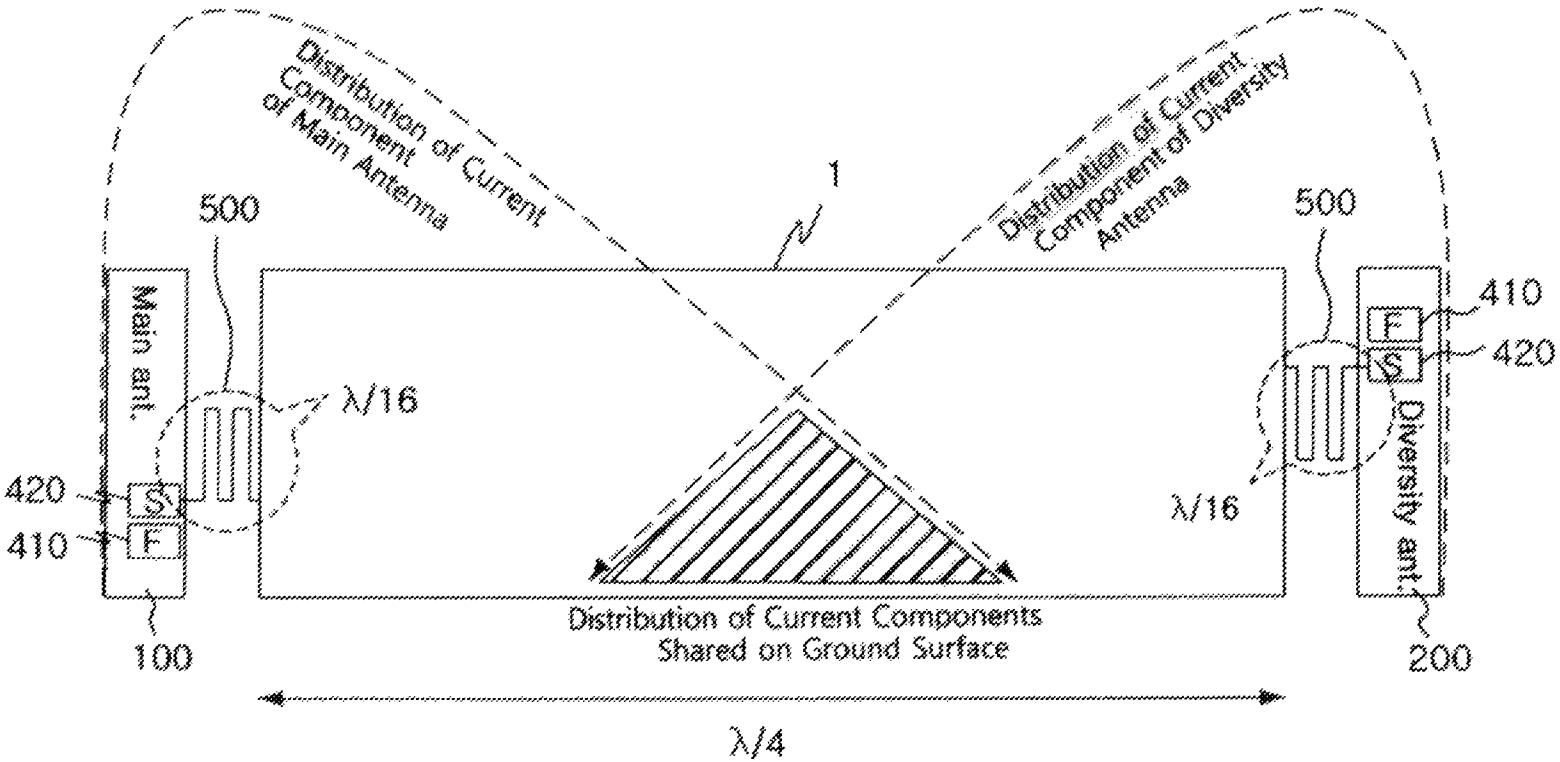
FIG. 4 is a diagram schematically illustrating current components shared on a ground surface by a plurality of planar inverted-F antennas that constitute a MIMO/diversity antenna according to the present invention.

FIG. 4 is a diagram schematically illustrating current components that are shared on a ground surface by the plurality of planar inverted-F antennas that constitute the MIMO/diversify antenna according to the present invention.

As illustrated in this drawing, the MIMO/diversity antenna according to an embodiment of the present invention includes a ground surface 1 formed on a printed circuit board (PCB); a plurality of planar inverted-F antennas 100 and 200 disposed on portions of the PCB where the ground surface 1 is not formed, with the ground surface 1 being interposed therebetween, and configured to have respective antenna patterns each including a radiation portion 330, a feeding portion 310, and a ground portion 320 and operating in multiple frequency bands; a plurality of feeding pads 410 and ground pads 420 formed on portions of the PCB where the ground surface 1 is not formed, so as to correspond to the feeding and ground portions of the antenna patterns provided in the plurality of planar inverted-F antennas; and a plurality of connection patterns configured to connect the ground surface with the ground pads in order to electrically connect the ground surface 420 to the ground portions 320 provided in the antenna patterns 300 of the plurality of planar inverted-F antennas. In this case, at least one connection pattern of the plurality of connection patterns 300 is formed of a meander line-shaped stripline.

In this case, a low frequency pattern 332 that belongs to each of the antenna patterns 300 that constitute the plurality of planar inverted-F antennas 100 and 200 and operate in multiple frequency bands and that operates in a relatively low frequency band operates in a specific frequency band lower than 1 GHz, and a total length obtained by summing the length of the plurality of connection patterns 500 and the length of the ground surface 1 formed between the plurality of planar inverted-F antennas 100 and 200 is formed to be equal to or greater than $3\lambda/8$ of the specific frequency band in which the low frequency pattern 332 operates. In this embodiment of the present invention, it is preferred that the specific frequency band be 869 MHz, the length of the ground surface 1 be $\lambda/4$ and the length of the plurality of connection patterns 500 be $\lambda/16$.

Furthermore, in the MIMO/diversity antenna according to this embodiment of the present invention, although not shown in the drawing, the plurality of connection patterns 500 that connect the ground surface 1 with the ground pads 420 are formed in the direction of the low frequency pattern 332 that belongs to the antenna patterns 300 that constitute the plurality of planar inverted-F antennas 100 and 200 and operate in multiple frequency bands and that is configured to operate in a relatively low frequency band.

As described above, the MIMO/diversity antenna according to this embodiment of the present invention is configured such that at least one connection pattern of the plurality of connection patterns is formed of a meander line-shaped stripline and such that a total length obtained by summing the length of the plurality of connection patterns 500 and the length of the ground surface 1 formed between the plurality of planar inverted-F antennas is formed to be equal to or greater than $3\lambda/8$ of the specific frequency band in which the low frequency pattern 332 operates, thereby compensating for the physical length between the ground surface on the PCB and the ground portions of the plurality of planar inverted-F antennas. Accordingly, the advantage of minimizing the distribution of current components shared on the ground surface by the plurality of planar inverted-F antennas and the advantage of preventing electromagnetic interference attributable to electromagnetic waves radiated emitted from the plurality of planar inverted-F antennas arise.

Figure 5:
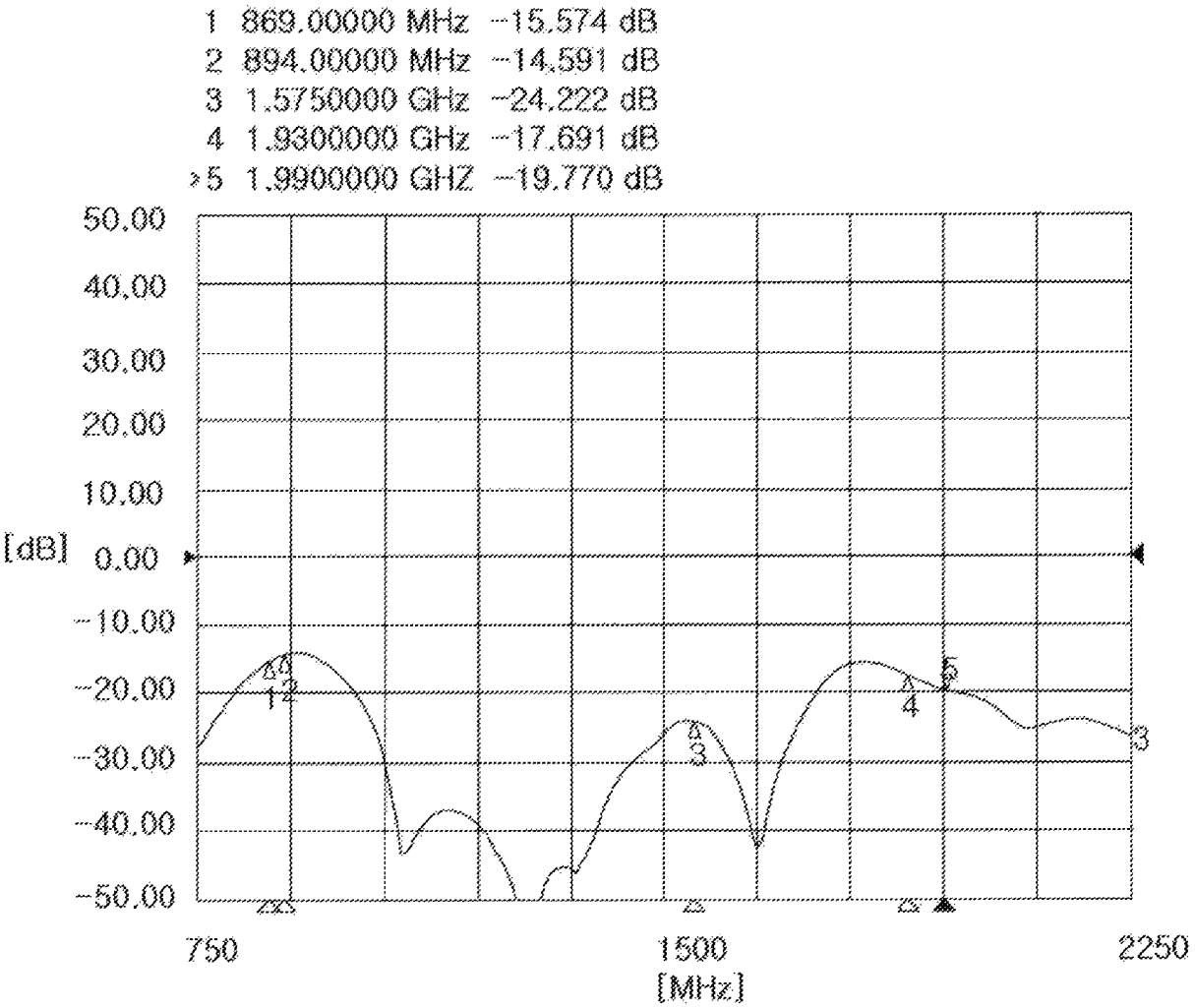
FIG. 5 is a diagram illustrating the isolation of the MIMO/diversify antenna according to the present invention.

FIG. 5 is a diagram illustrating the isolation of a MIMO/diversity antenna according to the present invention.

Figure 1:
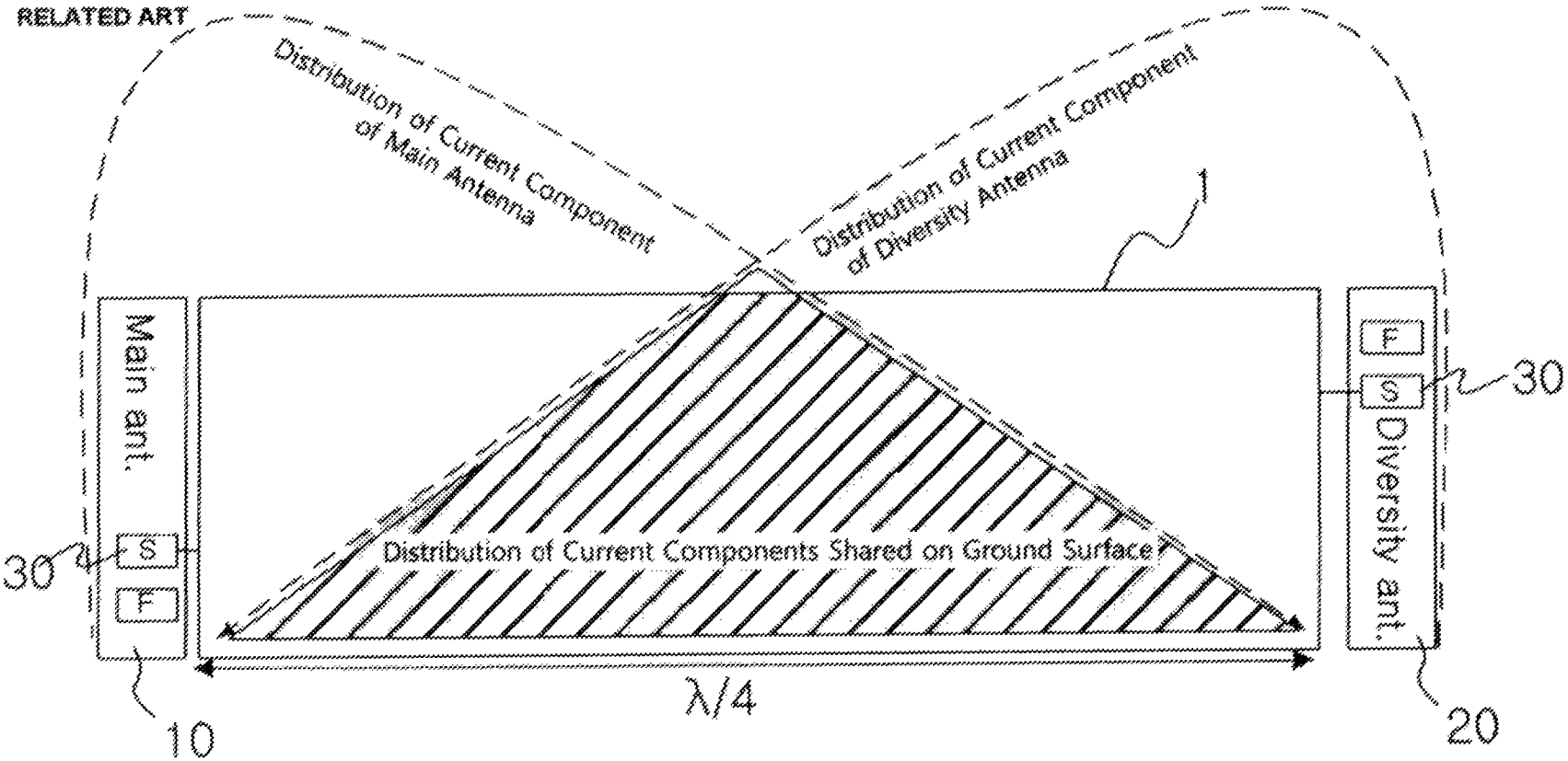
FIG. 1 RELATED ART
FIG. 1 is a diagram schematically illustrating current components shared on a ground surface by a plurality of planar inverted-F antennas that constitute a conventional MIMO/diversity antenna.
Figure 2:
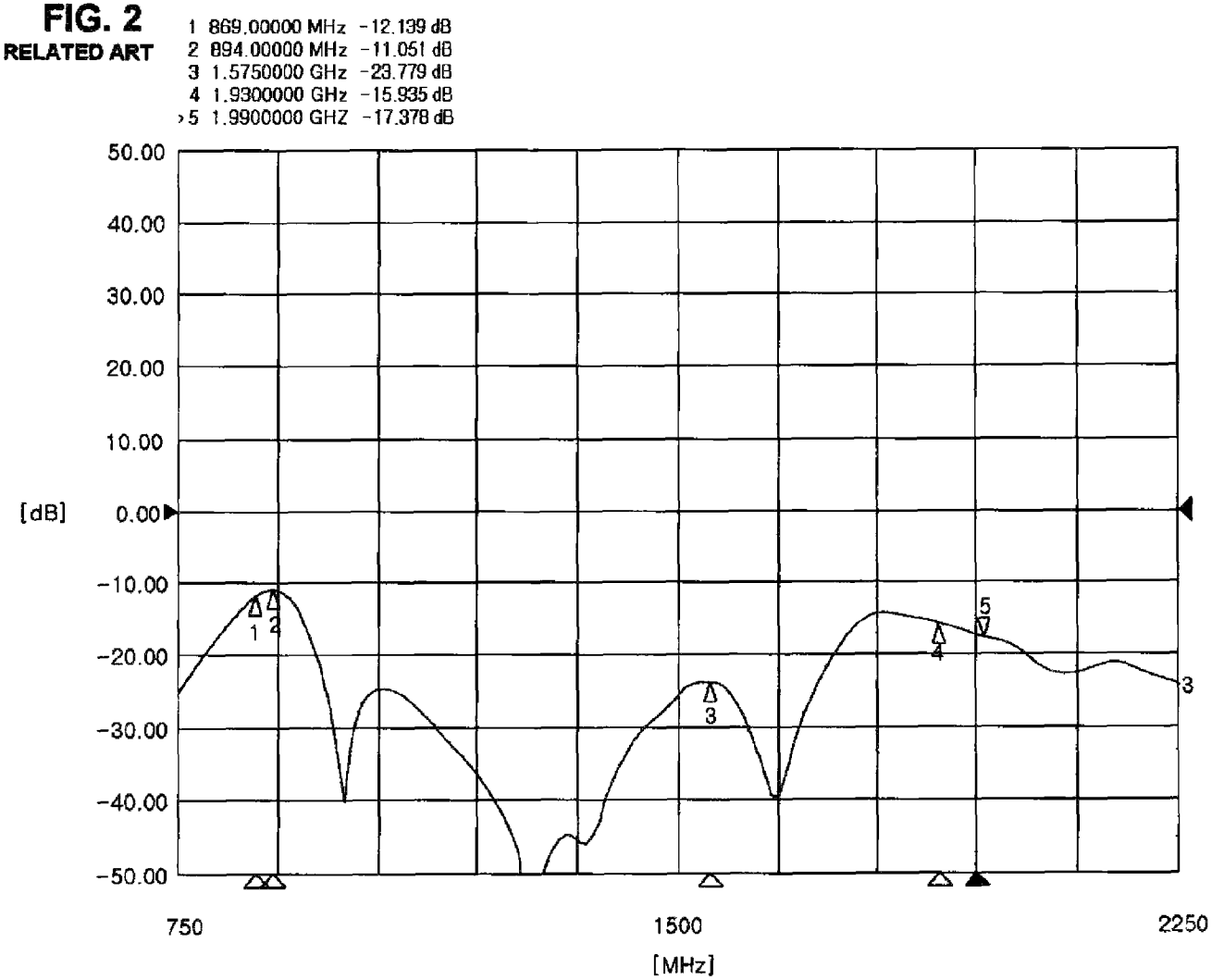
FIG. 2 RELATED ART
FIG. 2 is a diagram illustrating the isolation of the conventional MIMO/diversity antenna.

As illustrated in this drawing, in the MIMO/diversity antenna according to this embodiment of the present invention, it can be seen that the isolation in the 869 MHz frequency band was improved from −11 dB, that is, a conventional isolation illustrated in FIG. 2, to −15 dB, the problem in which the antenna characteristics in the high frequency band were relatively lowered when the antenna characteristics in a low frequency band were improved did not occur, and the antenna characteristics in a high frequency band equal to or higher than 1 GHz were partially improved compared to the conventional MIMO/diversity antenna characteristics, as illustrated in the drawing.

As described above, the MIMO/diversity antenna according to the present invention compensates for the physical length formed between the ground surface on the PCB and the ground portions of the plurality of planar inverted-F antennas, thereby achieving the advantages of reducing the distribution of current components shared on the ground surface by the plurality of planar inverted-F antennas and also preventing electromagnetic interference attributable to electromagnetic waves radiated from the plurality of planar inverted-F antennas.

As described above, the present invention has the advantage of providing the MIMO/diversity antenna for improving isolation, in which, in order to electrically connect the ground surface formed on the PCB with the ground portions provided in the antenna patterns of the plurality of planar inverted-F antennas, at least one connection pattern of a plurality of connection patterns that connect the ground surface with the ground pads is formed of a meander line-shaped stripline thereby minimizing the distribution of current components shared on the ground surface by the plurality of planar inverted-F antennas and also preventing electromagnetic interference attributable to electromagnetic waves radiated from the plurality of planar inverted-F antennas, resulting in an improvement in Isolation and antenna characteristics.

Although the present invention has been described in detail, it is clearly noted that the embodiments mentioned in the description are merely illustrative but are not limitative. The modifications and variations of elements that can be treated as being equivalent within the range that does not depart from the technical spirit and scope of the present invention that are provided by the attached claims.

The invention claimed is:

1. A MIMO (Multi-Input Multi-Output)/diversity antenna for improving isolation of a specific frequency band, comprising:

a ground surface formed on a printed circuit board (PCB);

a plurality of planar inverted-F antennas disposed on portions of the PCB where the ground surface is not formed, with the ground surface being interposed therebetween, and configured to have antenna patterns each including a radiation portion, a feeding portion, and a ground portion;

a plurality of feeding pads and ground pads formed on portions of the PCB where the ground surface is not formed, so as to correspond to the feeding and ground portions of the antenna patterns provided in the plurality of planar inverted-F antennas; and a plurality of connection patterns configured to connect the ground surface with the ground pads in order to electrically connect the ground surface to the ground portions provided in the antenna patterns of the plurality of planar inverted-F antennas;

wherein at least one of the plurality of connection patterns is formed of a meander line-shaped stripline, thereby minimizing distribution of current components shared on the ground surface by the plurality of planar inverted-F antennas, and also preventing electromagnetic interference attributable to electromagnetic waves radiated from the plurality of planar inverted-F antennas.

2. The MIMO/diversity antenna of claim 1, wherein:

the antenna patterns provided in the plurality of planar inverted-F antennas operate in a specific frequency band lower than 1 GHz; and a total length obtained by summing a length of the plurality of connection patterns and a length of the ground surface formed between the plurality of planar inverted-F antennas is equal to or greater than $3\lambda/8$ of the specific frequency band in which the frequency pattern operates.

3. A MIMO (Multi-Input Multi-Output)/diversity antenna for improving isolation of a specific frequency band, comprising:

a ground surface formed on a PCB (printed circuit board);

a plurality of planar inverted-F antennas disposed on portions of the PCB where the ground surface is not formed, with the ground surface being interposed therebetween, and configured to have respective antenna patterns each including a radiation portion, a feeding portion, and a ground portion and operating in multiple frequency bands;

a plurality of feeding pads and ground pads formed on portions of the PCB where the ground surface is not formed, so as to correspond to the feeding and ground portions of the antenna patterns provided in the plurality of planar inverted-F antennas; and a plurality of connection patterns configured to connect the ground surface with the ground pads in order to electrically connect the ground surface to the ground portions provided in the antenna patterns of the plurality of planar inverted-F antennas;

wherein at least one of the plurality of connection patterns is formed of a meander line-shaped stripline, thereby minimizing distribution of current components shared on the ground surface by the plurality of planar inverted-F antennas, and also preventing electromagnetic interference attributable to electromagnetic waves radiated from the plurality of planar inverted-F antennas.

4. The MIMO/diversity antenna of claim 3, wherein:

the feeding portions of the antenna patterns included in the plurality of planar inverted-F antennas and configured to operate in multiple frequency bands are configured to be disposed on a high frequency pattern side configured to operate in a relatively high frequency band, and the ground portions of the antenna patterns are configured to be disposed on a low frequency pattern side configured to operate in a relatively low frequency band; and the plurality of connection patterns are formed in a direction of the low frequency pattern side that is configured to operate in a relatively low frequency band.

5. The MIMO/diversity antenna of claim 4, wherein:

low frequency patterns that belong to the antenna patterns that constitute the plurality of planar inverted-F antennas and operate in multiple frequency bands and that operate in a relatively low frequency band operate in a specific frequency band lower than 1 GHz; and a total length obtained by summing a length of the plurality of connection patterns and a length of the ground surface formed between the plurality of planar inverted-F antennas is equal to or greater than $3\lambda/8$ of the specific frequency band in which the low frequency patterns operate.

* * * * *